US008261465B2

(12) United States Patent
Mayer et al.

(10) Patent No.: US 8,261,465 B2
(45) Date of Patent: Sep. 11, 2012

(54) EQUIPMENT AND METHOD FOR PRODUCING AND/OR TREATING A FIBROUS WEB

(75) Inventors: Roland Mayer, Heidenheim (DE); Antje Stein, Heidenheim (DE); Markus Oechsle, Bartholomae (DE); Frank Wegehaupt, Ulm (DE)

(73) Assignee: Voith Paper Patent GmbH, Heidenheim (DE)

( * ) Notice: Subject to any disclaimer, the term of this patent is extended or adjusted under 35 U.S.C. 154(b) by 1258 days.

(21) Appl. No.: 11/074,682

(22) Filed: Mar. 9, 2005

(65) Prior Publication Data

US 2005/0144802 A1 Jul. 7, 2005

Related U.S. Application Data

(63) Continuation of application No. PCT/EP03/50337, filed on Jul. 28, 2003.

(30) Foreign Application Priority Data

Sep. 10, 2002 (DE) ..... 102 41 944

(51) Int. Cl.
*F26B 25/00* (2006.01)

(52) U.S. Cl. ..... 34/114; 34/119; 34/122; 34/124; 162/206; 162/207; 118/100; 118/110

(58) Field of Classification Search ..... 34/455, 34/114, 119, 122, 124, 130, 446, 90; 162/206, 162/207; 118/100, 110
See application file for complete search history.

(56) References Cited

U.S. PATENT DOCUMENTS

| | | | | |
|---|---|---|---|---|
| 3,590,493 | A * | 7/1971 | Gretz | 34/190 |
| 3,658,642 | A * | 4/1972 | Keyes et al. | 162/197 |
| 3,798,785 | A * | 3/1974 | Chamouton | 34/568 |
| 3,948,721 | A * | 4/1976 | Winheim | 162/207 |
| 3,984,721 | A * | 10/1976 | Sato et al. | 313/371 |
| 4,378,639 | A * | 4/1983 | Walker | 34/389 |
| 4,915,788 | A * | 4/1990 | Winheim | 162/207 |
| 5,286,348 | A | 2/1994 | Perin | |
| 5,416,980 | A * | 5/1995 | Ilvespaa | 34/117 |
| 5,557,860 | A * | 9/1996 | Kotitschke et al. | 34/455 |
| 5,592,751 | A | 1/1997 | Guggemos et al. | |
| 5,771,603 | A * | 6/1998 | Kotitschke et al. | 34/446 |
| 6,038,789 | A * | 3/2000 | Kaihovirta et al. | 34/448 |
| 6,094,838 | A * | 8/2000 | Lang | 34/117 |

(Continued)

FOREIGN PATENT DOCUMENTS

DE 195 48307 6/1997

(Continued)

OTHER PUBLICATIONS

First Japanese Office Action and English language translation thereof.

(Continued)

*Primary Examiner* — Stephen M. Gravini
(74) *Attorney, Agent, or Firm* — Greenblum & Bernstein, P.L.C.

(57) ABSTRACT

Device and process for producing and treating a fibrous web. The device includes a moistening unit structured and arranged to simultaneously influence a cross machine moisture profile of the web and the curl of the web independently of each other. The instant abstract is neither intended to define the invention disclosed in this specification nor intended to limit the scope of the invention in any way.

55 Claims, 2 Drawing Sheets

U.S. PATENT DOCUMENTS

| | | | | |
|---|---|---|---|---|
| 6,250,376 | B1 * | 6/2001 | Hendrix | 165/90 |
| 6,365,004 | B1 * | 4/2002 | Hamstrom et al. | 162/198 |
| 6,383,337 | B1 * | 5/2002 | Meinecke et al. | 162/183 |
| 6,442,865 | B1 | 9/2002 | Wolf et al. | |
| 6,494,988 | B1 * | 12/2002 | Cedra et al. | 162/135 |
| 6,579,416 | B1 * | 6/2003 | Vinson et al. | 162/158 |
| 6,698,342 | B1 | 3/2004 | Heikkinen et al. | |
| 2003/0000673 | A1 * | 1/2003 | Anderson | 162/207 |
| 2003/0145481 | A1 * | 8/2003 | Zagar et al. | 34/83 |

FOREIGN PATENT DOCUMENTS

| | | |
|---|---|---|
| DE | 198 41768 | 3/2000 |
| DE | 199 49236 | 6/2001 |
| DE | 100 55999 | 5/2002 |
| EP | 0742313 | 11/1996 |
| EP | 1 050 622 | 8/2000 |
| JP | 54-151605 | 11/1979 |
| WO | 00/00696 | 1/2000 |
| WO | 01/23666 | 4/2001 |

OTHER PUBLICATIONS

Final Japanese Office Action and English language translation thereof.

English language translation of a Chinese Office Action dated Dec. 8, 2006.

* cited by examiner

EQUIPMENT AND METHOD FOR PRODUCING AND/OR TREATING A FIBROUS WEB

CROSS-REFERENCE TO RELATED APPLICATIONS

The present application is a Continuation International Application No. PCT/EP 2003/050337 Filed Jul. 28, 2003, and claims priority of German Patent Application No. 102 41 944.2, filed on Sep. 10, 2002. Moreover, the disclosure of International Application No. PCT/EP 2003/050337 is expressly incorporated by reference herein in its entirety.

BACKGROUND OF THE INVENTION

1. Field of the Invention

The invention relates to equipment and a method for producing and/or treating a fibrous web, in particular a paper or board web.

2. Discussion of Background Information

In order to influence curl of paper webs, for example water is applied uniformly over the paper web width preferably with nozzles. It is important that the water is applied to one side or, in the event of application to both sides, is at least applied to the two sides in different quantities. The change in the swelling of the fibers between the top side and the underside of the web during the drying process is influenced in a specific manner thereby and the curl behavior is appropriately corrected.

The water can be applied via nozzles or via specific roll applicators. In particular in the case of high-quality papers, attention must additionally be paid to the best possible cross-machine moisture profile. The present invention is directed to nozzle moisteners which can be controlled section by section.

Hitherto, in each case separate devices were required for the simultaneous influencing of curl and cross-machine moisture profiles. Such known designs are, however, very costly with respect to investment and maintenance.

In the nozzle moisteners which have been usual hitherto for setting the cross-machine moisture profile, the maximum applied amount per nozzle lies in a range from 12 to 15 l/h with a droplet diameter according to Sauter≦100 μm. What is known as the Sauter diameter is an average diameter which is used for spray characterization. A drop with this diameter has the same ratio of volume to surface as the entire (spray) sample, i.e. the sum of all the surfaces and volumes.

In the case of the equipment which has been usual hitherto, the correction of the curl, i.e. the flatness of the paper, is carried out by directed to a two-row arrangement of the drying cylinders, at least at the end of the drying section, or the application of steam to the underside of the paper after the drying section and/or an additional application of water to the underside of the paper web.

With the equipment known hitherto, the result is to some extent a relatively poor flatness of the paper.

SUMMARY OF THE INVENTION

The presented invention provides improved equipment and an improved method of the type mentioned at the beginning in which the aforementioned disadvantages are eliminated.

The presented invention is directed to equipment for producing and/or treating a fibrous web, in particular paper or board web, having a moistening unit used simultaneously both to influence the cross-machine moisture profile and to influence the curl of the fibrous web. In this moistening unit it is possible for the cross-machine moisture profile and the curl to be influenced independently of each other.

On the basis of this design, the corrections of the cross-machine moisture profile and of the curl are directed to a single compact unit, such as directed to a single nozzle moistener. This is of considerable advantage above all in the case of graphic papers, such as newsprint and, in particular, SC papers which are produced in the online process (press and supercalender).

According to the invention, therefore, two requirements or functions (cross-machine moisture profile, flatness) are combined and implemented in a single unit. Thus, for example, equalization of the cross-machine moisture profile of the fibrous web is possible with simultaneous minimum rewetting of the web over the entire width in order to ensure the flatness of the fibrous web. Reliable cross-machine moisture profile control and correction of the flatness is even ensured at higher machine speeds, that is to say with a shorter residence time of the web in the region of the moistening unit. The equipment according to the invention is in particular also suitable for papers of high grammage.

It is also important in particular that the two functions (cross-machine moisture profile, curl) can be fulfilled not just in parallel but also independently of each other, in spite of the use of a single moistening unit.

In a preferred practical embodiment of the equipment according to the invention, the moistening unit comprises a nozzle moistener used simultaneously both to influence the cross-machine moisture profile and to influence the curl of the fibrous web.

The nozzle moistener can be provided with pneumatic atomizer nozzles.

The nozzle moistener is advantageously provided with two-material nozzles. These can for example have a construction such as is described in DE 199 49 236 A. It is therefore possible to use two-material spray nozzles to which in particular a gaseous medium and a liquid medium are applied.

The average throughput of the nozzles of the nozzle moistener, determined from the total throughput of the nozzles divided by their number, is preferably ≧15 l/h. In this case, the average throughput of the nozzles of the nozzle moistener can lie in particular in a range from 15 l/h to 30 l/h and preferably in a range from 15 l/h to 20 l/h.

The average throughput of all the nozzles should therefore be greater than or equal to 15 l/h, if possible. In this case, the average nozzle throughput is defined by the ratio of the total throughput of the moistening unit to the total number of nozzles.

In each spray jet produced by the moistening unit, the droplet diameter according to Sauter is preferably ≦100 μm, regardless of the respective nozzle throughput.

Therefore, in particular even at high web running speeds of, for example, v≧1200 m/min and in particular ≧1400 m/min, it is ensured that the droplet size distribution of a respective spray jet is still sufficiently fine even at higher nozzle throughputs. In the moistening unit according to the invention, the nozzle throughput is higher than in the known nozzle moisteners, since the throughput is composed of a proportion for influencing the curl and a proportion for influencing the cross-machine moisture profile.

In a preferred practical embodiment of the equipment according to the invention, during the operation, the average nozzle throughput is kept at least substantially constant.

Therefore, for example during production of a particular paper grade, it is possible for the average nozzle throughput to be kept constant in order not to subject the amount of water to be evaporated in the following drying to any fluctuations over time, which denotes that time-stable final drynesses in the paper web are achieved.

As already mentioned, a respective nozzle throughput can be composed in particular of a proportion for influencing the cross-machine moisture profile and a proportion for influencing the curl. In this case, the proportion for influencing the curl, provided as a base load, can in particular lie or be adjustable in a range between 10 and 50% of the total nozzle throughput.

The proportion for influencing the curl, provided as the base load, can preferably be adjusted differently section by section over the web width. In principle, however, the proportion for influencing the curl, provided as the base load, can also be constant over the web width.

The capacity of the moistening equipment is preferably chosen to be sufficiently high that, in spite of a base load for the curl, there is sufficient potential for influencing the cross-machine moisture profile.

It is also advantageous in particular if the proportion of the average throughput of the nozzles relating to influencing the curl is ≧2 l/h, in particular ≧3 l/h and preferably ≧4 l/h.

The moistening unit preferably comprises a plurality of rows of nozzles in each case extending transversely with respect to the web running direction. In this case, two or four rows of nozzles, for example, can be provided. Five, six, seven or eight rows of nozzles can also advantageously be provided, six or eight rows of nozzles preferably being provided.

A plurality of constructional and technological concepts of a nozzle moistener for simultaneous profiling and influencing curl are conceivable.

Thus, according to an expedient embodiment of the equipment according to the invention, for example all the nozzles of the nozzle moistener can be used simultaneously both to influence the cross-machine moisture profile and to influence the curl of the fibrous web.

In another expedient embodiment, for example some of the nozzles of the nozzle moistener are used exclusively to influence the cross-machine moisture profile, and some of the nozzles are used exclusively to influence the curl.

According to a further expedient embodiment, some of the nozzles of the nozzle moistener are used simultaneously both to influence the cross-machine moisture profile and to influence the curl of the fibrous web, and some of the nozzles are used exclusively to influence the curl.

For instance, an embodiment in which some of the nozzles of the nozzle moistener are used simultaneously both to influence the cross-machine moisture profile and to influence the curl of the fibrous web, and some of the nozzles are used exclusively to influence the cross-machine moisture profile is also conceivable.

In principle, any other desired nozzle moistener concepts are also conceivable.

The volume of spray discharged by the moistening unit in order to influence the cross-machine moisture profile can preferably be adjusted separately section by section as viewed in the transverse direction. Each individual nozzle can preferably be adjusted separately.

At least in order to influence the cross-machine moisture profile, at least one closed control loop and/or at least one open control loop is advantageously provided.

In a preferred practical embodiment of the equipment according to the invention, the closed-loop or open-loop control of the influence on the curl is carried out as a function of the average web moisture and in particular the magnitude of the curl determined in the laboratory test.

The moistening unit is advantageously arranged in a region in which the dryness of the fibrous web is ≧80% and preferably ≧85%.

The sectioning or zonal division is preferably variable. For example, the zone width can be variable in a range between 25 and 100 mm.

The moistening unit is preferably arranged underneath the lower rolls within a single-row drying group.

In specific cases, it is also advantageous if the moistening unit is installed on the last suction roll of the last or penultimate drying group.

According to a further expedient embodiment of the equipment according to the invention, a steam blower box is provided in order to exert an additional influence on the curl or the flatness and the surface finish of the fibrous web before or within a calendering device following the drying section. The moistening unit according to the invention can therefore be provided in particular in combination with a steam moistener used before or within a calendering device following the drying section in order to improve the flatness and surface finish of the paper further.

The equipment according to the invention can be used with particular advantage in a papermaking process having complete or partly one-sided drying of the paper or board or having one-sided surface treatment, for example sizing or coating, or having an asymmetrical layer structure.

The present invention is directed to a method for producing and/or treating a fibrous web, in particular a paper or board web, in which, in order to influence the cross-machine moisture profile and to influence the curl of the fibrous web. A common moistening unit is used such that the cross-machine moisture profile and the curl can be influenced separately from each other.

Preferred refinements of the method according to the invention are specified in subclaims.

On the basis of the solution according to the invention, a single unit is thus sufficient to correct the moisture and the flatness. The result overall is a lower requirement for investment and a lower expenditure on maintenance. Since, with the unit according to the invention for rewetting the fibrous web in order to influence the cross-machine moisture profile and the flatness of the fibrous web simultaneously, the use of moistening equipment downstream for curl correction is dispensed with, subsequent, undesired influencing of the moisture profile and the surface characteristics of the paper is also ruled out.

Other exemplary embodiments and advantages of the present invention may be ascertained by reviewing the present disclosure and the accompanying drawing.

The present invention discloses a device for at least one of treating and producing a web. The device includes a moistening unit structured and arranged to simultaneously influence a cross machine moisture profile of the web and the curl of the web independently of each other.

According to another feature of the invention the moistening unit includes at least one nozzle moistener structured and arranged to simultaneously influence the cross machine moisture profile of the web and the curl of the web. The nozzle moistener includes at least one pneumatic atomizer nozzle.

According to another feature of the invention, the nozzle moistener includes nozzles structured to emit at least two materials. Further, the nozzle moistener comprises a plurality of nozzles structure such that an average throughput of the nozzles determined from a total throughput of the nozzles divided by the number of nozzles, is ≧15 l/h. Further still, the average throughput of the nozzles of the nozzle moistener is in the range from 15 l/h to 30 l/h. The average throughput of the nozzles of the nozzle moistener is substantially in the range from 15 l/h to 20 l/h.

According to another feature of the invention, the nozzle of the nozzle moistener produces a spray jet, wherein the spray jet has a droplet diameter according to Sauter ≦100 μm, regardless of the respective nozzle throughput. Further, each nozzle of the nozzle moistener during operation, has an average nozzle throughput kept at least substantially constant. Further still, the throughput of each nozzle of the nozzle moistener comprises a portion for influencing the cross machine moisture profile and a portion for moistening the curl. Wherein, the portion for influencing the curl is provided as a base load, and the base load is adjustable in a range in or between 10% and 50% of the total nozzle throughput. Further, the base load is adjustable differently section by section over a web width. wherein said base load is constant over the web width.

According to another feature of the invention, the moistening device has sufficient capacity to influence the cross machine moisture profile in addition to supplying the base load. Wherein the portion of the average throughput of the nozzles relating to influencing the curl is ≧2 l/h. Further, the portion of the average throughput of the nozzles relating to influencing the curl is ≧3 l/h. Further still, the portion of the average throughput of the nozzles relating to influencing the curl is substantially ≧4 l/h.

According to another feature of the invention, the plurality of nozzles are arranged in a plurality of rows extending transversely with respect to a web running direction. Wherein the plurality of rows of the nozzles is either two or four rows. Further, the plurality of rows of the nozzles is either five, or six, or seven, or eight rows. Further still, the plurality of rows of the nozzles is substantially six or eight rows.

According to another feature of the invention, all the nozzles of the nozzle moistener simultaneously influence the cross machine moisture profile and the curl of the web. The nozzles of the nozzle moistener are structured and arranged to exclusively influence the cross machine moisture profile and some of the nozzles of the nozzle moistener are structured and arranged to exclusively influence the curl of the web. Wherein some of the nozzles of the nozzle moistener are structured and arranged to simultaneously influence the cross machine moisture profile and the curl of the web, and some of said nozzles of the nozzle moistener are structured and arranged to exclusively influence the curl of the web. Further, some of the nozzles of the nozzle moistener are structured and arranged to simultaneously influence the cross machine moisture profile and the curl of the web, and some of said nozzles of said nozzle moistener are structured and arranged to exclusively influence the cross machine moisture profile.

According to another feature of the invention, a volume of spray discharged the moistening unit to influence the cross machine moisture profile is adjustable section by section as viewed in a direction transverse to a web direction. Wherein the nozzles are arranged in a plurality of rows, and each the nozzle is individually adjustable.

According to another feature of the invention, at least one open control loop and at least one closed control loop arranged to influence at least the cross machine moisture profile. Wherein the at least one closed control loop and/or open control loop is arranged to control the influence on the curl as a function of the average web moisture. Further, the closed control loop and/or open control loop control the influence of the curl as a function of a magnitude of the curl as determined in a laboratory test.

According to another feature of the invention, the moistening unit is arranged in a region in which a dryness of the web is ≧80%. Wherein the moistening unit is arranged in a region in which a dryness of the web is substantially ≧85%. Further, a sectioning or zonal division is variable. Further still, a zone width is in a range between 25 mm and 100 mm.

According to another feature of the invention, a single row drying group, and the moistening unit is arranged underneath lower rolls within the single row drying group. Further, at least two drying groups, such that at least a last two drying groups relative to the web direction include at least one suction roll. Further still, the moistening unit is installed on a last suction roll of one the last two drying groups.

According to another feature of the invention, the device includes a steam box and a calendering device arranged downstream from a drying section. Wherein the steam box is structured and arranged to influence the curl or flatness and surface finish of the web one of before and within the calendering device.

According to another feature of the invention, a process for producing and/or treating a device. Wherein, the said process comprising one of: completely or partially one sided drying of the web, and one sided surface treatment on the web. Further, the treatment includes sizing or coating, or having an asymmetrical layer structure. Further still, the web is a paper or board web.

According to another feature of the invention, a process for a fibrous web comprising separately influencing a cross machine moisture profile and a curl of the web with a moistening unit. Further, the process of the web includes the web being paper or board. Further still, maintaining as at least substantially constant an average nozzle throughput, which is determined from a total throughput of nozzles divided by a total number of nozzles. Wherein influencing the cross machine moisture profile with at least one of closed control loop and open loop control. Further, comprising influencing the curl with at least one closed loop and open loop control. Further still, comprising influencing the curl with at least one of closed loop and open loop control as a function of an average web moisture. Wherein the curl is influenced as a function of a magnitude of the curl determined in a laboratory test.

According to another feature of the invention, the moistening unit includes a nozzle moistener with nozzles. Wherein the process comprises simultaneously influencing both the cross machine moisture profile and the curl of the web with all of the nozzles of the nozzle moistener. Further, the moistening unit includes a nozzle moistener with nozzles. Further still, the process comprises exclusively influencing the cross machine moisture profile with some of the nozzles and exclusively influencing the curl with some other of the nozzles. Wherein, simultaneously influencing the cross machine moisture profile and the curl of the web with some of the nozzles, and exclusively influencing the curl of the web with some other of the nozzles. Further, simultaneously influencing the curl and the cross machine moisture profile of the web with some of the nozzles, and exclusively influencing the cross machine moisture profile of the web with some other of the nozzles.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

The invention will be explained in more detail in the following text using an exemplary embodiment and with reference to the drawing, in which.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
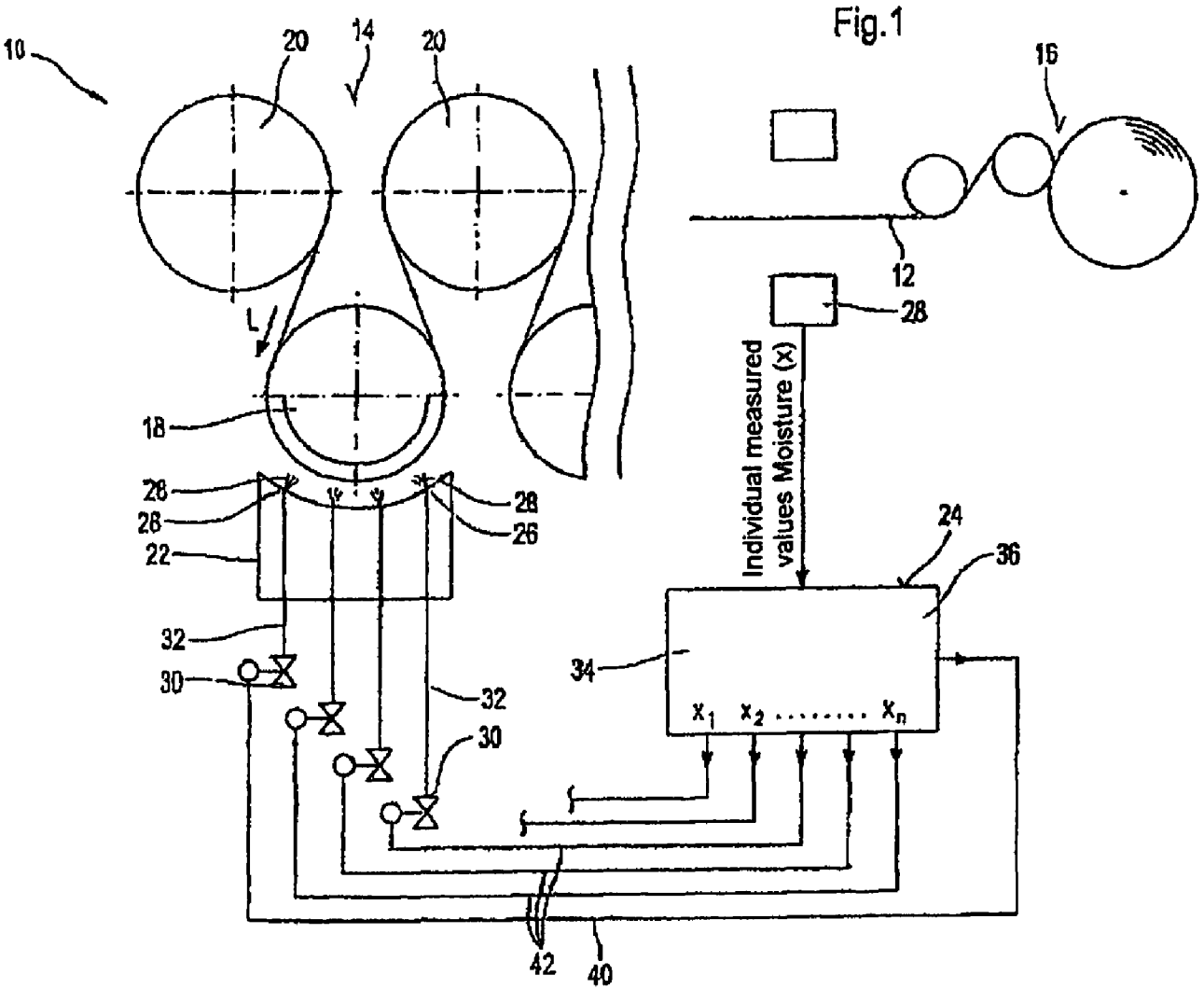
FIG. 1 shows a schematic partial illustration of a papermaking machine having a moistening unit with associated open-loop and/or closed-loop control unit used simultaneously both to influence the cross-machine moisture profile and to influence the curl of the fibrous web.

FIG. 1 shows, in a schematic partial illustration, equipment 10 for producing and/or treating a fibrous web 12, which can be in particular a paper or board web. The equipment 10 can also in particular be a papermaking machine. In FIG. 1, it is possible to see part of the drying section 14 and a reeling apparatus 16, in which the fibrous or paper web 12 is reeled up.

In the region of the drying section 14, in the present case underneath a suction roll 18 of a single-row drying group comprising upper drying cylinders 20, a moistening unit 22 is provided simultaneously both to influence the cross-machine moisture profile and to influence the curl of the fibrous web 12 and is assigned an open-loop and/or closed-loop control unit 24.

The moistening unit 22 can in particular comprise a nozzle moistener serving simultaneously both to influence the cross-machine moisture profile and to influence the curl of the fibrous web 12.

As can be seen from FIG. 1, the moistening unit 22 has a plurality of rows of nozzles 26, in the present case, for example, four rows of nozzles 26, extending transversely with respect to the web running direction L, via which the fibrous web 12 led around the suction roll 18 can be acted on appropriately.

A plurality of constructional and technological concepts of a nozzle moistener for simultaneous profiling and influencing curl are conceivable.

Thus, according to an expedient embodiment of the equipment according to the invention, for example all the nozzles of the nozzle moistener can be used simultaneously both to influence the cross-machine moisture profile and to influence the curl of the fibrous web.

In another expedient embodiment, for example some of the nozzles of the nozzle moistener are used exclusively to influence the cross-machine moisture profile and some of the nozzles are used exclusively to influence the curl.

According to a further expedient embodiment, some of the nozzles of the nozzle moistener are used simultaneously both to influence the cross-machine moisture profile and to influence the curl of the fibrous web, and some of the nozzles are used exclusively to influence the curl.

For instance, an embodiment in which some of the nozzles of the nozzle moistener are used simultaneously both to influence the cross-machine moisture profile and to influence the curl of the fibrous web, and some of the nozzles are used exclusively to influence the cross-machine moisture profile is also conceivable.

In principle, any other desired nozzle moistener concepts are also conceivable.

The moistening unit 22 formed by a nozzle moistener in the present case can in particular be provided with pneumatic atomizer nozzles 26 and, for example, with two-material nozzles 26, as described in DE 199 49 236 A. In principle, however, any other desired types of nozzles can also be used.

The average throughput of the nozzles 26, determined from the overall throughput of the nozzles 26 divided by their number, is preferably $\geqq 15$ l/h. In each spray jet 28 produced by the nozzles 26, the droplet diameter according to Sauter is preferably $\leqq 100$ μm, regardless of the respective nozzle throughput.

In the exemplary embodiment, the leading row of nozzles in the web running direction L is provided to influence the curl, while the following remaining three rows of nozzles 26 are used to influence the cross-machine moisture profile. As already mentioned, in principle any other desired number of rows of nozzles is also conceivable. Moreover, it is contemplated that all nozzles can simultaneously influence curl and cross-machine moisture profile, and/or that the remaining three rows of nozzles simultaneously influence curl and cross-machine profile.

In the region between the drying section 14 and the reeling apparatus 16, a traversing measuring device 29 is provided, which supplies individual measured values x for the web moisture and, in a corresponding way, respective instantaneous recordings of the cross-machine moisture profile to the open-loop and/or closed-loop control unit 24.

Via the open-loop and/or closed-loop control unit 24, valves 30 in the lines 32 leading to the rows of nozzles 26 are driven or regulated appropriately.

The spray volumes discharged by the relevant rows of nozzles 26 in order to influence the cross-machine moisture profile are preferably adjustable separately section by section as viewed in the transverse direction. In particular, an embodiment in which the cross-machine moisture profile can be adjusted separately for each relevant row of nozzles is also conceivable. In order to influence the cross-machine moisture profile, the open-loop and/or closed-loop control unit 24 can comprise one or more closed and/or open control loops 34. The open-loop and/or closed-loop control unit 24 also preferably again comprises one or more closed and/or open control loops 36 in order to influence the curl. In addition, for example, one or more open and/or closed control loops supervising these can also be provided. In general, open-loop and/or closed-loop control comprising both functions (cross-machine moisture profile, curl) is conceivable.

In order to influence the curl, the relevant row of nozzles 26, here for example the first row of nozzles as viewed in the web running direction L, is acted on via the open-loop and/or closed-loop control unit 24 through control line 40 with an appropriate manipulated variable, which has been produced in the open-loop and/or closed-loop control unit 24, for example, is directed to averaging over the width, and via which the base load which determines the proportion of the nozzle throughput for influencing the curl is adjusted.

Via the control lines 42 connected to the control outputs $x_1$-$x_n$ of the open-loop and/or closed-loop control unit 24, the valves 26 of the remaining rows of valves used to influence the cross-machine moisture profile are acted on with the relevant local moisture values $x_i$. In this case, cross-machine moisture profile control can in particular be carried out. In principle, however, open-loop control is also conceivable. In addition, in principle both open-loop control and closed-loop control are also conceivable with respect to influencing the curl. The manipulated variable for influencing the curl can in principle also be adjustable by hand.

In order to produce a respective paper grade, the average mean nozzle throughput can be kept at least substantially constant.

Figure 2:
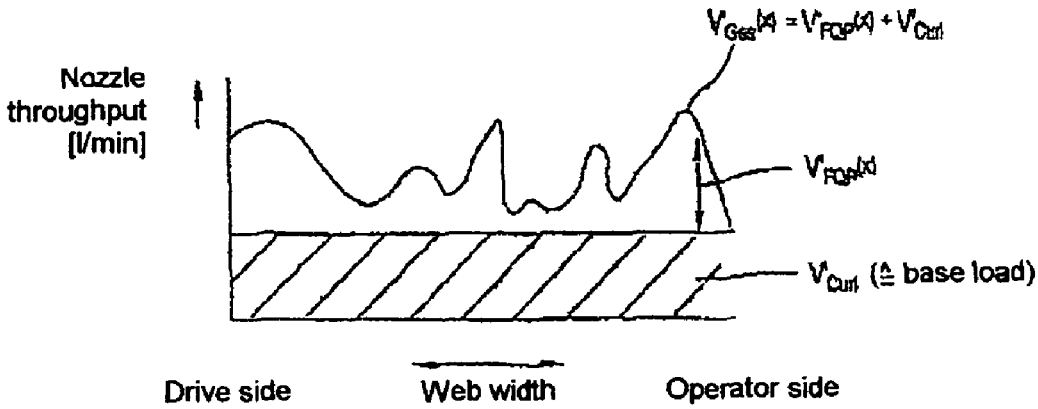
FIG. 2 shows a graph in which the nozzle throughput across the web width is illustrated.

In the graph according to FIG. 2, the nozzle throughput over the web width is illustrated. As can be seen from this graph, a respective nozzle throughput (volume/time) $V'_{Ges}(x)$ is composed of a proportion $V'_{FQP}(X)$ for influencing the cross-machine moisture profile and a proportion $V'_{Curl}$ for influencing the curl. In this case, the proportion $V'_{Curl}$ for influencing the curl forms a type of base load, to which the variable proportion $V'_{FQP}$ for influencing the cross-machine moisture profile is added. The proportion for influencing the curl, provided as a base load, can be constant over the web width or adjustable differently section by section.

Figure 3:
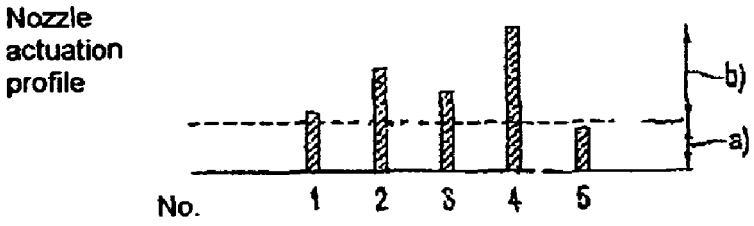
FIG. 3 shows a graph in which an exemplary actuating or reference profile of the nozzles is indicated.

In the graph according to FIG. 3, an actuating or reference profile of the nozzles is indicated, purely by way of example. In this case, the range a) indicates the base load for the curl and b) indicates the range for the profiling. If a plurality of rows of nozzles are provided, these can have identical actuating or reference profiles or else different actuating or reference profiles. As already mentioned previously, in principle various nozzle moistener concepts can be used.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

List of Reference Symbols

10 Equipment, papermaking machine
12 Fibrous web
14 Drying section
16 Reeling apparatus
18 Suction roll
20 Drying cylinder
22 Moistening unit
24 Open-loop and/or closed-loop control unit
26 Nozzle, row of nozzles
28 Jet spray
29 Traversing measuring device
30 Valve
32 Line
34 Closed and/or open control loop
36 Closed and/or open control loop
40 Control line
42 Control line
a Base load for the curl
b Range for the profiling
x Individual measured value for the moisture
L Web running direction

What is claimed:

1. A device for at least one of treating and producing a web comprising:

a moistening unit having at least one nozzle structured and arranged to simultaneously influence a cross machine moisture profile of the web and a curl of the web, the at least one nozzle comprising a plurality of rows of nozzles arranged in an area of a roll, and said rows of nozzles being oriented along a curved path around the roll and applying moisture to a side of the web opposite the roll.

2. A device for at least one of treating and producing a web comprising:

a moistening unit having at least one nozzle structured and arranged to simultaneously influence a cross machine moisture profile of the web and a curl of the web, said at least one nozzle comprising a plurality of rows of nozzles arranged in an area of a roll and said plurality of rows of nozzles includes at least one pneumatic atomizer nozzle, and each row of the rows of nozzles applying moisture to a different portion of the web as it travels along a curved path around the roll and applying moisture to a side of the web opposite the roll.

3. A device for at least one of treating and producing a web comprising:

a moistening unit having at least one nozzle structured and arranged to simultaneously influence a cross machine moisture profile of the web and a curl of the web, said at least one nozzle comprising a plurality of rows of nozzles arranged in an area of a roll and said plurality of rows of nozzles includes nozzles wherein a throughput comprises a portion influencing the cross machine moisture profile and a portion moistening the curl, said portion influencing the curl being provided as a base load, and said base load being adjustable in a range in or between 10% and 50% of the total nozzle throughput.

4. The device in accordance with claim 1, wherein an average throughput of nozzles of said plurality of rows of nozzles determined from a total throughput of the nozzles divided by the number of nozzles, is $\geqq$15 l/h.

5. The device in accordance with claim 4, wherein said average throughput is in the range from 15 l/h to 30 l/h.

6. The device in accordance with claim 4, wherein said average throughput is substantially in the range from 15 l/h to 20 l/h.

7. The device in accordance with claim 4, wherein each said nozzle produces a spray jet, and said spray jet has a droplet diameter according to Sauter $\leqq$100 μm, regardless of the respective nozzle throughput.

8. The device in accordance with claim 4, wherein each said nozzle during operation, has an average nozzle throughput kept at least substantially constant.

9. The device in accordance with claim 4,
wherein the throughput of each said nozzle comprises a portion for influencing the cross machine moisture profile and a portion for moistening the curl.

10. The device in accordance with claim 9,
wherein said portion for influencing the curl is provided as a base load, and
wherein said base load is adjustable in a range in or between 10% and 50% of the total nozzle throughput.

11. The device in accordance with claim 10,
wherein said base load is adjustable differently section by section over a web width.

12. The device in accordance with claim 10,
wherein said base load is constant over the web width.

13. The device in accordance with claim 10,
wherein said moistening unit has sufficient capacity to influence the cross machine moisture profile in addition to supplying the base load.

14. The device in accordance with claim 10,
wherein the portion of the average throughput of said nozzles relating to influencing the curl is ≧2 l/h.

15. The device in accordance with claim 9,
wherein the portion of the average throughput of said nozzles relating to influencing the curl is ≧3 1/h.

16. The device in accordance with claim 9,
wherein the portion of the average throughput of said nozzles relating to influencing the curl is substantially ≧4 l/h.

17. The device in accordance with claim 4,
wherein said plurality of rows of nozzles extend transversely with respect to a web running direction.

18. The device in accordance with claim 17,
wherein said plurality of rows of said nozzles is either two or four rows.

19. The device in accordance with claim 17,
wherein said plurality of rows of said nozzles is either five, or six, or seven, or eight rows.

20. The device in accordance with claim 17,
wherein said plurality of rows of said nozzles is substantially six or eight rows.

21. The device in accordance with claim 1,
wherein, all nozzles of said plurality of rows of nozzles simultaneously influence the cross machine moisture profile and the curl of the web.

22. The device in accordance with claim 4,
wherein some of said nozzles of said plurality of rows of nozzles are structured and arranged to exclusively influence the cross machine moisture profile and some of said nozzles of said plurality of rows of nozzles are structured and arranged to exclusively influence the curl of the web.

23. The device in accordance with claim 4,
wherein some of said nozzles of said plurality of rows of nozzles are structured and arranged to simultaneously influence the cross machine moisture profile and the curl of the web, and some of said nozzles of said plurality of rows of nozzles are structured and arranged to exclusively influence the curl of the web.

24. The device in accordance with claim 4,
wherein some of said nozzles of said plurality of rows of nozzles are structured and arranged to simultaneously influence the cross machine moisture profile and the curl of the web, and some of said nozzles of said plurality of rows of nozzles are structured and arranged to exclusively influence the cross machine moisture profile.

25. The device in accordance with claim 1,
wherein a volume of spray discharged from said moistening unit to influence the cross machine moisture profile is adjustable section by section as viewed in a direction transverse to a web direction.

26. The device in accordance with claim 22,
wherein each said nozzle is individually adjustable.

27. The device in accordance with claim 1,
further comprising at least one open control loop and at least one closed control loop arranged to influence at least the cross machine moisture profile.

28. The device in accordance with claim 27,
wherein said at least one closed control loop and/or open control loop is arranged to control the influence on the curl as a function of the average web moisture.

29. The device in accordance with claim 27,
wherein said closed control loop and/or open control loop control the influence of the curl as a function of a magnitude of the curl as determined in a laboratory test.

30. The device in accordance with claim 1,
wherein said moistening unit is arranged in a region in which a dryness of the web is ≧80%.

31. The device in accordance with claim 1,
wherein said moistening unit is arranged in a region in which a dryness of the web is substantially ≧85%.

32. The device in accordance with claim 1,
further comprising a sectioning or zonal division that is variable.

33. The device in accordance with claim 32,
wherein a zone width is in a range between 25 mm and 100 mm.

34. The device in accordance with claim 1,
further comprising a single row drying group, and
wherein said roll is a lower roll of the single row drying group and said moistening unit is arranged underneath said lower roll within said single row drying group.

35. The device in accordance with claim 1,
further comprising at least two drying groups, wherein at least a last two drying groups relative to the web direction include said roll; and
said roll comprises a last suction roll,
wherein said moistening unit is installed on the last suction roll of one the last two drying groups.

36. The device in accordance with claim 1,
further comprising a steam box; and
a calendering device arranged downstream from a drying section,
wherein said steam box is structured and arranged to influence the curl or flatness and surface finish of the web one of before and within said calendering device.

37. A process for producing and/or treating a device in accordance with claim 1,
said process comprising one of: completely or partially one sided drying of the web, and one sided surface treatment on the web.

38. The process in accordance with claim 37,
wherein treatment includes sizing or coating, or having an asymmetrical layer structure.

39. The device in accordance with claim 1,
wherein the web is a paper or board web.

40. A process for a fibrous web using the device of claim 1, comprising:
separately influencing a cross machine moisture profile and a curl of the web with said moistening unit.

41. A process in accordance with claim 40:
said process of the web includes the web being paper or board.

42. A process in accordance with claim 40:

maintaining as at least substantially constant an average nozzle throughput, which is determined from a total throughput of nozzles divided by a total number of nozzles.

43. A process in accordance with claim 40:

further comprising influencing the cross machine moisture profile with at least one of closed control loop and open loop control.

44. A process in accordance with claim 40:

further comprising influencing the curl with at least one closed loop and open loop control.

45. A process in accordance with claim 40:

further comprising influencing the curl with at least one of closed loop and open loop control as a function of an average web moisture.

46. A process in accordance with claim 45:

wherein the curl is influenced as a function of a magnitude of the curl determined in a laboratory test.

47. A process in accordance with claim 40:

wherein the process further comprises:

simultaneously influencing both the cross machine moisture profile and the curl of the web with all of the nozzles of the plurality of rows of nozzles.

48. A process in accordance with claim 40:

wherein the process further comprises:

exclusively influencing the cross machine moisture profile with some of the nozzles; and exclusively influencing the curl with some other of the nozzles.

49. A process in accordance with claim 40:

simultaneously influencing the cross machine moisture profile and the curl of the web with some of the nozzles; and exclusively influencing the curl of the web with some other of the nozzles.

50. A process in accordance with claim 45:

simultaneously influencing the curl and the cross machine moisture profile of the web with some of the nozzles; and exclusively influencing the cross machine moisture profile of the web with some other of the nozzles.

51. The device in accordance with claim 1, wherein said plurality of rows of nozzles comprise nozzles influencing the curl and nozzles influencing the cross machine moisture profile independently of the nozzles influencing the curl.

52. The device in accordance with claim 51, wherein a throughput of said nozzles influencing the curl is different from a throughput of said nozzles influencing the cross machine moisture profile.

53. The device in accordance with claim 52, wherein the throughput of said nozzles influencing the curl comprises an adjustable base load that is between 10% and 50% of a total throughput.

54. The device in accordance with claim 1, further comprising:

a measuring device located downstream of the moistening unit; and a control receiving input from the measuring device and controlling the measuring unit.

55. The device in accordance with claim 1, one of:

the plurality of rows of nozzles are controlled separately; and the plurality of rows of nozzles comprising one row of nozzles being utilized to influence the cross machine moisture profile and another row of nozzles being utilized to influence the curl.

* * * * *